US007445303B2

(12) United States Patent
Arakawa et al.

(10) Patent No.: US 7,445,303 B2
(45) Date of Patent: Nov. 4, 2008

(54) IMAGE RECORDING APPARATUS

(75) Inventors: Hiroaki Arakawa, Uenohara (JP); Tetsuo Uno, Tokyo (JP)

(73) Assignee: Konica Minolta Holding, Inc., Tokyo (JP)

( * ) Notice: Subject to any disclaimer, the term of this patent is extended or adjusted under 35 U.S.C. 154(b) by 400 days.

(21) Appl. No.: 11/286,467

(22) Filed: Nov. 25, 2005

(65) Prior Publication Data

US 2006/0119678 A1 Jun. 8, 2006

(30) Foreign Application Priority Data

Dec. 3, 2004 (JP) ..... 2004-351356

(51) Int. Cl.
*B41J 29/38* (2006.01)

(52) U.S. Cl. ..... 347/9

(58) Field of Classification Search ..... 347/9, 347/10, 11, 14, 15, 19
See application file for complete search history.

(56) References Cited

U.S. PATENT DOCUMENTS 4,788,563 A * 11/1988 Omo et al. ..... 347/14
5,835,115 A * 11/1998 Kitazawa ..... 347/57
5,936,648 A * 8/1999 Minowa et al. ..... 347/35
6,663,208 B2 * 12/2003 Suzuki et al. ..... 347/10
7,131,713 B2 * 11/2006 Otsuka et al. ..... 347/15

* cited by examiner

*Primary Examiner*—Anh T. N. Vo
(74) *Attorney, Agent, or Firm*—Lucas & Mercanti, LLP

(57) ABSTRACT

There is described an image recording apparatus, which makes it possible to improve the operation efficiency of the host computer for high-speed image recording. The apparatus includes: a recording head having a plurality of ink emitting nozzles; a plurality of storing sections to store ink emitting data for every unit ink emitting action; a controller to selectively designate a specific storing section from the plurality of storing sections corresponding to a current progress status of ink emitting actions, and to sequentially read out the ink emitting data from the specific storing section for every unit ink emitting action, in order to depict the specific printing pattern; a shift register to sequentially store the ink emitting data, read by the controller, for every unit ink emitting action; and a head driving section to sequentially drive the recording head for every unit ink emitting action, based on the ink emitting data.

8 Claims, 8 Drawing Sheets

IMAGE RECORDING APPARATUS

This application is based on Japanese Patent Application NO. 2004-351356 filed on Dec. 3, 2004 in Japanese Patent Office, the entire content of which is hereby incorporated by reference.

BACKGROUND OF THE INVENTION

The present invention relates to an image recording apparatus, particularly to an image recording apparatus for recording an image by emission of ink.

In such an image recording apparatus as an inkjet printer, the command and tag data are removed from the transfer data transferred from a personal computer and host computer of a workstation and the image data is extracted; then a recording head is driven according to the image data, in general cases. The recording head is provided with a register for storing the image data. The recording head is driven according to the image data stored in the register and ink is emitted to a recording medium, whereby image is recorded (Patent Document 1). In recent years, the aforementioned image recording apparatus is used to produce color films for the organic electroluminescent display (EL) and liquid crystal display.

[Patent Document 1]

Tokkaihei 11-138798 (Japanese Non-Examined Patent Publication)

Assume that the definition becomes higher as the dot pitch S1 of the filter pattern (print pattern) C of the color film gets smaller than the nozzle pitch S2 of the recording head H. Then if the recording head H is tilted in the scanning direction as shown in FIG. 8, a pattern can be formed in such a way that the nozzle pitch S3 as viewed from the scanning direction is reduced. If the recording head is not tilted in the scanning direction, the same image data will be transferred from the start point of the film pattern to the end point, for example, when the same pattern is formed. If the recording head H is tilted in the scanning direction S as described above, the emission pattern from the nozzle (hereinafter, also referred to as an ink emitting nozzle) may differ according to the degree of the tilt at the start point and end point of the film pattern C. Accordingly, the same image data cannot be used, hence image data must be transferred.

As the definition of the film pattern gets higher, the number of the recording heads to be installed and the number of the nozzles of a single recording head tends to increase. With the increase in the number of recording heads and nozzles, there is a reduction in the duration of time to transfer the image data from the host computer in conformance to the emission from each nozzle. If the image data transfer speed becomes incompatible with emission from each nozzle, the emission speed must be reduced in order to make it compatible, with the result that the time required for image recording is unnecessarily prolonged.

SUMMARY OF THE INVENTION

To overcome the abovementioned drawbacks in conventional image-recording apparatus, it is an object of the present invention to provide image recording apparatus, which makes it possible to improve the operation efficiency of the host computer for high-speed image recording by preventing the image recording time from being prolonged by higher definition of the color film filter pattern, wherein the load in image transfer processing by the host computer is reduced.

Accordingly, to overcome the cited shortcomings, the abovementioned object of the present invention can be attained by image-recording apparatus described as follow.

(1) An image recording apparatus, comprising: a recording head that includes a plurality of ink emitting nozzles for emitting ink onto a recording medium, wherein the plurality of ink emitting nozzles are aligned in a linear direction intersecting a plane orthogonal to a conveying direction of the recording medium with a predetermined angle; a plurality of storing sections to store ink emitting data for every unit ink emitting action, wherein the ink emitting data represent an ink emitting action conducted by each of the plurality of ink emitting nozzles corresponding to a specific printing pattern; a controller to selectively designate a specific storing section form the plurality of storing sections corresponding to a current progress status of ink emitting actions conducted by the plurality of ink emitting nozzles, and to sequentially read out the ink emitting data from the specific storing section for every unit ink emitting action, in order to depict the specific printing pattern; a shift register to sequentially store the ink emitting data, read by the controller, for every unit ink emitting action; and a head driving section to sequentially drive the recording head for every unit ink emitting action, based on the ink emitting data.

According to the invention described in item 1, the ink emitting data on one-time emission stored in a plurality of storing sections (hereinafter, also referred to as storage sections) is read out by a data reading section, and is stored in a shift register. After that, the head driving section drives the recording head, based on the stored ink emitting data on one-time emission. When one and the same print pattern is to be image-recorded several times, image recording can be performed several times by using the ink emitting data in each storage section, without having to transfer the ink emitting data every time. This arrangement reduces the number of times the ink emitting data is sent, and prevents the image recording time from being prolonged, even if the higher definition of the print pattern of the color filter has been used. Thus, a higher image speed is ensured.

(2) The image recording apparatus of item 1, wherein the ink emitting data includes at least two of ink-emitting initial data, ink-emitting final data and ink-emitting intermediate data; and wherein the ink-emitting initial data represent ink emitting actions to be conducted from a time when a leading ink-emitting nozzle, located at a leading edge portion of the recording head, is positioned on an image recording start line of the recording medium to a time when a trailing ink-emitting nozzle, located at a trailing edge portion of the recording head, is positioned on the image recording start line; the ink-emitting final data represent ink emitting actions to be conducted from a time when the leading ink-emitting nozzle is positioned on an image recording stop line of the recording medium to a time when the trailing ink-emitting nozzle is positioned on the image recording stop line; and the ink-emitting intermediate data represent ink emitting actions to be conducted during an intermediate time interval from a completion of the ink-emitting initial data to a start of the ink-emitting final data.

(3) The image recording apparatus of item 2, wherein, when at least two of the ink-emitting initial data, the ink-emitting intermediate data and the ink-emitting final data are stored into the shift register as the ink emitting data, the head driving section drives the recording head, based on the ink emitting data stored in the shift register.

According to the invention described in item 3, at least two of the ink-emitting initial data, ink-emitting intermediate data and ink-emitting final data stored in a plurality of storage sections are read out by the data reading section and are stored in the shift register. After that, based on at least two of the stored ink-emitting initial data, ink-emitting intermediate data and ink-emitting final data or the transfer data thereof, the head driving section drives the recording head. Especially when multiple pieces of stored data are classified as the ink-emitting initial data, ink-emitting intermediate data and ink-emitting final data, the ink-emitting initial data is in charge from the time the nozzle of the leading edge is positioned at the image recording start point on the recording medium, to the time the nozzle of the trailing end is positioned therein; the ink-emitting intermediate data is in charge from the time the trailing nozzle is positioned at the image recording start point of the recording medium, to the time the leading nozzle is positioned at the image recording completion point of the recording medium; and the ink-emitting final data is in charge from the time the leading nozzle is positioned at the point immediately below the image recording completion point, to the time the trailing nozzle is located at the image recording completion point.

(4) The image recording apparatus of item 3, wherein the plurality of storing sections includes an ink-emitting initial data storage for storing the ink-emitting initial data, an ink-emitting intermediate data storage for storing the ink-emitting intermediate data and an ink-emitting final data storage for storing the ink-emitting final data.

According to the invention described in item 4, multiple storage sections are made up of a ink-emitting initial data storing section for storing the ink-emitting initial data, an ink-emitting intermediate data storing section for storing the ink-emitting intermediate data and a ink-emitting final data storing section for storing the ink-emitting final data. This allows the ink-emitting initial data, ink-emitting intermediate data and ink-emitting final data to be managed separately.

(5) The image recording apparatus of item 4, wherein, after the ink-emitting initial data are stored into the shift register, the controller repeatedly reads out the ink-emitting intermediate data for a predetermined number of times from the ink-emitting intermediate data storage so that the ink-emitting intermediate data read-out are sequentially stored into the shift register.

According to the invention described in item 5, after storing the ink-emitting initial data having been read once, the shift register stores the ink-emitting intermediate data having been read out a predetermined number of times. After that, the shift register stores the ink-emitting final data having been read out once. This arrangement ensures the ink-emitting initial data, ink-emitting intermediate data and ink-emitting final data to be stored in the shift register in that order. The head driving section drives the recording head based on the ink emitting data stored in the shift register. If the ink-emitting initial data, ink-emitting intermediate data and ink-emitting final data are stored in that order as described above, the reading heads are driven in that order. This ensures the image to be recorded in the correct order.

(6) The image recording apparatus of item 4, wherein the ink-emitting initial data, the ink-emitting intermediate data and the ink-emitting final data are stored into the shift register; and wherein the head driving section drives the recording head so that the recording head repeatedly conducts a same ink emitting action for a predetermined number of times, based on the ink-emitting intermediate data stored in the shift register.

According to the invention described in item 6, after storing the ink-emitting initial data having been read once, the shift register stores the ink-emitting intermediate data having been read out once. Then it stores the ink-emitting final data having been read out. This arrangement ensures the ink-emitting initial data, ink-emitting intermediate data and ink-emitting final data to be stored in the shift register in that order. The head driving section drives the recording head based on the ink emitting data stored in the shift register. If the ink-emitting initial data, ink-emitting intermediate data and ink-emitting final data are stored in that order as described above, the reading heads are driven in that order. This ensures the image to be recorded in the correct order. Here in the ink-emitting intermediate data out of the ink-emitting initial data, ink-emitting intermediate data and ink-emitting final data as ink emitting data on a plurality of emissions, all the nozzles of the recording heads are located within the area from the image recording start point to the image recording completion point, and therefore, the same data pattern is obtained. If the data pattern of the ink-emitting intermediate data is the same, it can be used repeatedly so long as all the nozzles of the recording head are located within the area from the image recording start point to the image recording completion point. As described above, when the head driving section drives the recording head based on the ink-emitting intermediate data, data transfer time can be reduced if the ink-emitting intermediate data is repeatedly used a predetermined number of times, as compared to the case where the ink-emitting intermediate data is read out several times.

(7) An image recording apparatus, comprising: a recording head that includes a plurality of ink emitting nozzles for emitting ink onto a recording medium, wherein the plurality of ink emitting nozzles are aligned in a linear direction intersecting a plane orthogonal to a conveying direction of the recording medium with a predetermined angle; an ink emitting data storing section that includes a plurality of storing sections to store ink emitting data for every unit ink emitting action, wherein the ink emitting data represent an ink emitting action conducted by each of the plurality of ink emitting nozzles corresponding to a specific printing pattern; an initial mask pattern storing section to store initial mask pattern data representing an initial mask pattern to be formed during a period from a time when a leading ink-emitting nozzle, located at a leading edge portion of the recording head, is positioned on an image recording start line of the recording medium to a time when a trailing ink-emitting nozzle, located at a trailing edge portion of the recording head, is positioned on the image recording start line; a final mask pattern storing section to store final mask pattern data representing a final mask pattern to be formed during a period from a time when the leading ink-emitting nozzle is positioned on an image recording stop line of the recording medium to a time when the trailing ink-emitting nozzle is positioned on the image recording stop line; an ink-emitting initial data synthesizing section to synthesize the ink emitting data, read from the ink emitting data storing section, and the final mask pattern data, read from the final mask pattern storing section, with each other, so as to generate and output ink-emitting initial data; an ink-emitting final data synthesizing section to synthesize the ink emitting data, read from the ink emitting data storing section, and the final mask pattern data, read from the final mask pattern storing section, with each other, so as to generate and output ink-emitting final data; a controller to selectively designate any one of the ink emitting data, the ink-emitting initial data and the ink-emitting final data, which are outputted from corresponding one of the ink emitting data storing section, the ink-emitting initial data synthesizing section and the ink-emitting final data synthesizing section, as designated ink-emitting data, corresponding to a current progress status of ink emitting actions conducted by the plurality of ink emitting nozzles; a shift register to sequentially store the designated ink-emitting data, designated by the controller, for every unit ink emitting action; and a head driving section to sequentially drive the recording head for every unit ink emitting action, based on the designated ink-emitting data.

According to the invention described in item 7, the non-synthesized ink emitting data, synthesized with the initial mask pattern data (initial synthesis data) and ink emitting data synthesized with final mask pattern (final synthesis data) are read by the data reading section, and the shift register stores the non-synthesized ink emitting data, initial synthesis data and final synthesis data. Then the head driving section drives the recording head based on the stored non-synthesized ink emitting data, initial synthesis data and final synthesis data. Accordingly, if the ink emitting data is stored in the ink emitting data storage section, initial synthesis data and final synthesis data can be formed without the ink emitting data being sent every time, even when the same print pattern is to be image-recorded several times. This arrangement allows the image to be recorded several times, and hence reduces the frequency of sending the ink emitting data. The image recording time is not unduly prolonged, despite higher definition of the color film print pattern, with the result that image recording speed is increased.

Further, the image recording is started from the time the leading nozzle is positioned to the image recording start point of the recording medium, to the time the trailing nozzle is positioned therein. This ensures that the initial mask pattern data is synthesized in the range where the ink emitting data is not uniform. In the meantime, the image recording is completed from the time the leading nozzle is positioned at the point immediately downstream from the image recording completion point of the recording medium, to the time the trailing nozzle is positioned at the image recording completion point. This ensures that the final mask pattern data is synthesized in the range where the ink emitting data is not uniform.

(8) The image recording apparatus of item 7, wherein, initially, the ink-emitting initial data are stored into the shift register as designated ink-emitting data, and next, the ink emitting data, which are repeatedly read out for a predetermined number of times, are stored into the shift register as designated ink-emitting data, and then, the ink-emitting final data are stored into the shift register as designated ink-emitting data.

According to the invention described in item 8, after storing the initial synthesis data having been read once, the shift register stores the non-synthesized ink emitting data having been read out a predetermined number of times. After that, the shift register stores the final synthesis data having been read out once. This arrangement ensures the initial synthesis data, non-synthesized ink emitting data, and final synthesis data to be stored in the shift register in that order. The head driving section drives the recording head based on the ink emitting data stored in the shift register. If the initial synthesis data, non-synthesized ink emitting data, and final synthesis data are stored in the shift register in that order, the reading heads are driven in that order. This ensures the image to be recorded in the correct order.

(9) The image recording apparatus of item 8, wherein the head driving section drives the recording head so that the recording head repeatedly conducts a same ink emitting action for a predetermined number of times, based on ink emitting data stored in the shift register.

*Further, to overcome the abovementioned problems, other image-recording apparatus, embodied in the present invention, will be described as follow:

According to the invention described in item 8, after storing the initial synthesis data having been read once, the shift register stores the non-synthesized ink emitting data having been read out. After that, the shift register stores the final synthesis data having been read out once. This arrangement ensures the initial synthesis data, non-synthesized ink emitting data, and final synthesis data are stored in the shift register in that order. The head driving section drives the recording head based on the ink emitting data stored in the shift register. If the initial synthesis data, non-synthesized ink emitting data, and final synthesis data are stored in that order, the reading heads are driven in that order. This ensures the image to be recorded in the correct order. Here in the non-synthesized ink emitting data, all the nozzles of the recording heads are located within the area from the image recording start point to the image recording completion point, and therefore, the same data pattern is obtained. If the data pattern in the non-synthesized ink emitting data is the same, it can be used repeatedly so long as all the nozzles of the recording head are located within the area from the image recording start point to the image recording completion point. As described above, when the head driving section drives the recording head based on the non-synthesized ink emitting data, transfer time can be reduced if the non-synthesized ink emitting data is repeatedly used a predetermined number of times, as compared to the case where the non-synthesized ink emitting data is read out several times.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Embodiment 1

Figure 1:
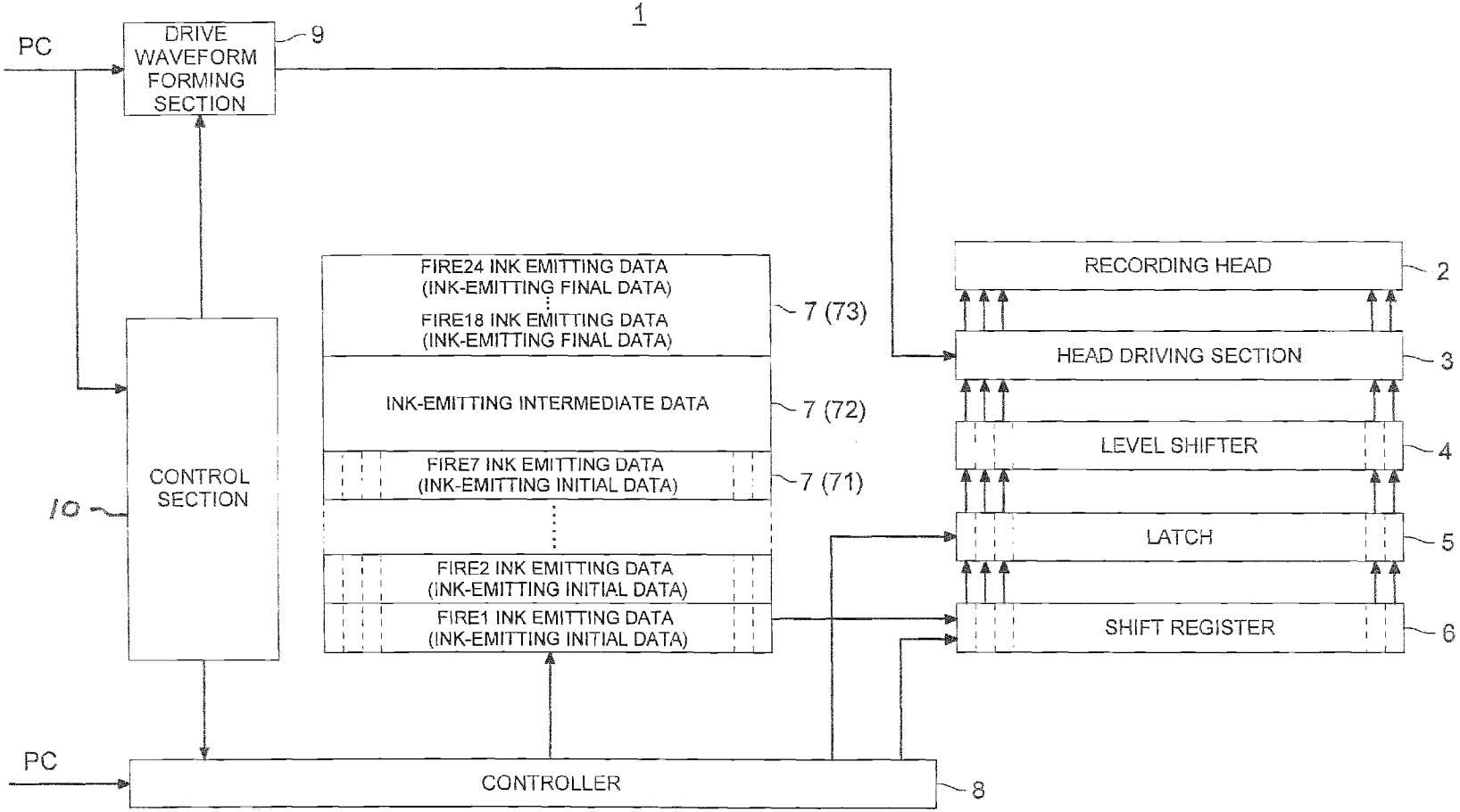
FIG. 1 is a block diagram representing a main control structure of an image recording apparatus as a first embodiment of the present invention.
Figure 2:
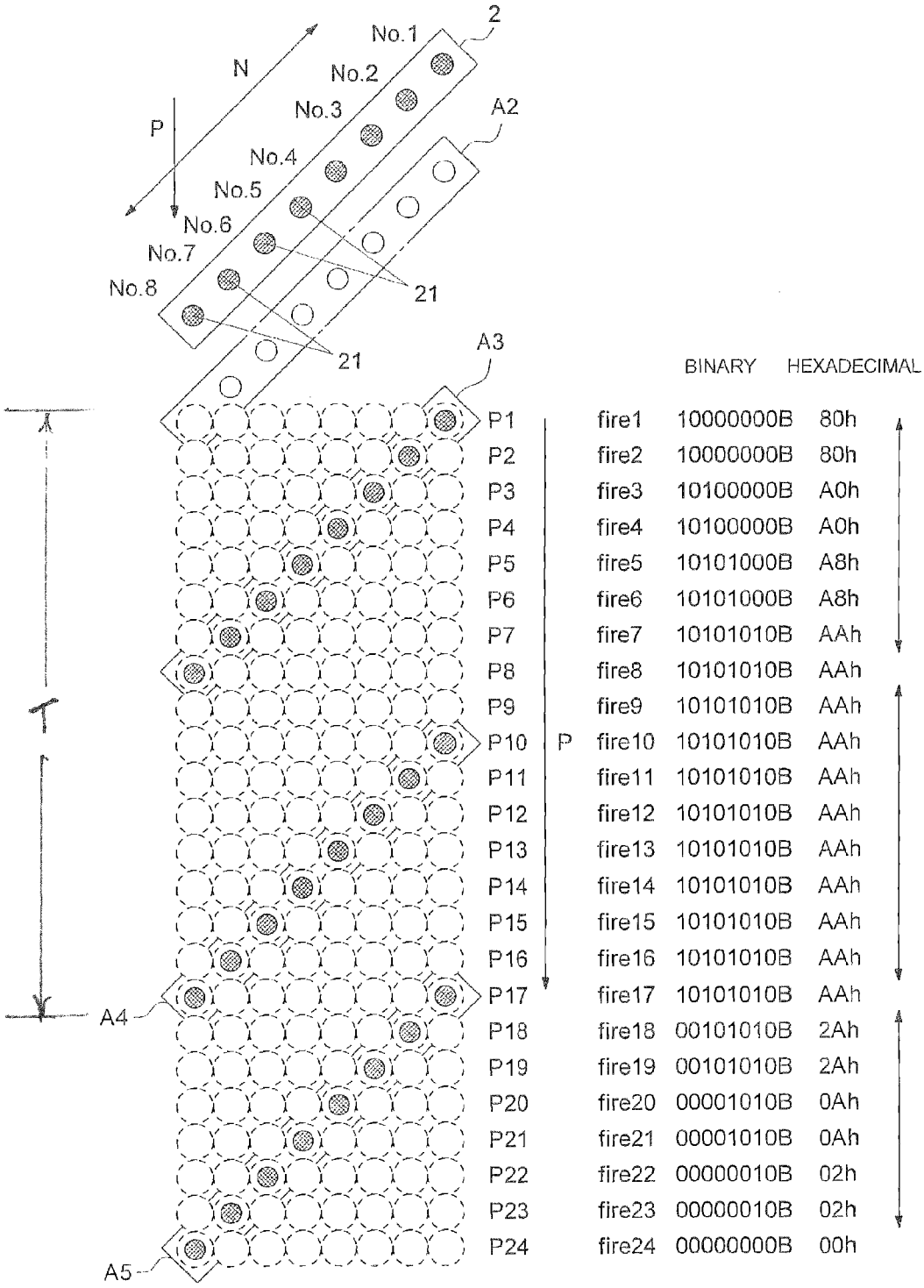
FIG. 2 is an explanatory diagram representing a relationship between each of nozzles of a recording head and an image recording area of a recording medium.

FIG. 1 is a block diagram representing the main control structure of an image recording apparatus as an embodiment of the present invention. As shown in FIG. 1, the image recording apparatus 1 is provided with a recording head 2 for emitting ink to a recording medium and recording an image on the recording medium. The recording head 2 is equipped with nozzles 21 (e.g. eight nozzles) for emitting ink and is arranged in such a way that the direction N in which the nozzles 21 are arranged is tilted with respect to the direction P in which the recording medium will be conveyed (FIG. 2). Assume that the nozzles 21 are numbered sequentially No. 1, No. 2, . . . No. 8, starting from the nozzle 21 located at the trailing end with respect to the direction of conveyance P. Thus, the nozzle 21 at the leading edge with respect to the direction of conveyance P is No. 8.

FIG. 2 is an explanatory diagram representing the relationship between each of nozzles 21 of the recording head 2 and the image recording area T of the recording medium. Here the image recording area T refers to the area wherein an image is recorded on the recording medium. In the present embodiment, the image recording area T corresponds to the matrix with eight rows and seventeen columns. As described above, the recording head 2 is arranged in a form tilted with respect to the direction of conveyance P. This arrangement allows only the nozzle 21 (No. 8) located at the leading edge of the recording head 2 to be located at the image recording start point (Point P1 in the 1st row) of the image recording area T at the time of starting image recording (one-dot chain line A2 in FIG. 2). To be more specific, the No. 8 nozzle 21 alone is allowed to emit ink on the image recording area of the recording medium at the image recording start point.

After that, when the recording medium is fed one pixel, the No. 8 nozzle 21 is positioned at point P2 of the second row, and the No. 7 nozzle 21 is positioned at point P1 of the first row. In this way, when No. 8 nozzle 21 is located at point P8 of the 8th row with the progress of image recording; the No. 7 nozzle 21 is positioned at point P7 of the 7th row; the No. 6 nozzle 21 is positioned at point P6 of the 6th row; the No. 5 nozzle 21 is positioned at point P5 of the 5th row; the No. 4 nozzle 21 is positioned at point P4 of the 4th row; the No. 3 nozzle 21 is positioned at point P3 of the 3rd row; the No. 2 nozzle 21 is positioned at point P2 of the 2nd row; and the No. 1 nozzle 21 is positioned at point P1 of the 1st row (one-dot chain line A3 in FIG. 2). In this state, ink can be emitted from all the nozzles 21 of the recording head 2 to the image recording area T. To be more specific, ink cannot be emitted to the image recording area T by any nozzle 21 if the nozzles 21, until the No. 1 nozzle 21 is positioned at point P1 of the 1st row, i.e. while the No. 8 nozzle 21 is located in the range from the point P1 of the 1st row to the destination point P7 of the 7th row. In this way, the mode from the time the leading nozzle 21 is located at the image recording start point of the recording medium, to the time the trailing nozzle 21 is located there occurs at the time of starting image recording. This mode will be referred to as image recording start mode in the following description.

All the nozzles 21 are located on the image recording area T from the time the No. 8 nozzle 21 is positioned at point P8 of the 8th row, to the time it is positioned at the image recording completion point of the image recording area T (e.g. destination point P17 of the 17th row) (one-dot chain line A4 in FIG. 2). This allows the ink to be emitted onto the image recording area T from all the nozzles 21. This mode occurs in the middle of image recording, and will be referred to as intermediate image recording mode in the following description.

After that, when the No. 8 nozzle 21 is positioned at the point immediately downstream from the image recording completion point (destination point P18 of 18th row), the No. 8 nozzle 21 is removed from the image recording area T. Other nozzles 21 such as No. 7, No. 6 . . . No. 2 are also removed from the image recording area T in that order with the progress of image recording. In the final phase of image recording, the No. 8 nozzle 21 is located at the point P24 of 24th row; the No. 7 nozzle 21 is located at the point P23 of 23rd row; the No. 6 nozzle 21 is located at the point P22 of 22nd row; the No. 5 nozzle 21 is located at the point P21 of 21st row; the No. 4 nozzle 21 is located at the point P20 of 20th row; the No. 3 nozzle 21 is located at the point P19 of 19th row; the No. 2 nozzle 21 is located at the point P18 of 18th row; and the No. 1 nozzle 21 is located at the point P17 of 17th row (one-dot chain line A5 of FIG. 2). As described above, from the time the No. 8 nozzle 21 is located at the point P18 of 18th row, to the time the No. 1 nozzle 21 is located at the point P17 of 17th row, ink cannot be emitted from any of the nozzles 21 of the recording head 2. The mode from the time the leading nozzle 21 is positioned at the point immediately downstream from the image recording completion point of the recording medium to the time the trailing nozzle 21 is located at the image recording completion point occurs at the time of completion of image recording. This mode will be referred to as image recording completion mode in the following description.

In the present embodiment, the recording head 2 with eight nozzles 21 arranged thereon has been used as an example for explanation, without the total number of the nozzles 21 being restricted thereto if there are one or more nozzles 21. Assume that the total number of the nozzles 21 is "n" and the image recording completion point is "m" (where m>n). When the leading nozzle 21 is located at "n−1"-th row from the point of the 1st row, the system is in the image recording start mode. When the leading nozzle 21 is located at the area ranging from the n-th row to the m-th row, the system is in the intermediate image recording mode. When the leading nozzle 21 is located at the area ranging from the "m+1st" row to the "m+n−1st" row, the system is in the image recording completion mode. To be more specific, the intermediate image recording mode occurs between the image recording start mode and image recording completion mode.

The recording head 2 is electrically connected with the head driving section 3 for driving the recording head 2, as shown in FIG. 1. The head driving section 3 is electrically connected with a plurality of storage sections 71, 72 and 73 through a level shifter 4, latch 5 and shift register 6. The storage sections 7 separately stores the ink emitting data on a plurality of emissions from each of the nozzles 21 of the recording head 2 formed based on the print pattern.

The ink emitting data on a plurality of emissions includes the ink-emitting initial data for the recording head 2 in image recording start mode, the ink-emitting intermediate data for the recording head 2 of the intermediate image recording mode, and the ink-emitting final data for the recording head 2 of the image recording completion mode. In this case, "fire1" denotes the emission when the No. 8 nozzle 21 of the recording head 2 is located at the point P1 of the 1st row; "fire2" denotes the emission when it is located at the point P2 of the 2nd row; "fire3" denotes the emission when it is located at the point P3 of the 3rd row; and so on. Reference numerals are given sequentially in this manner. Since the emissions fire1 through fire7 are in the image recording start mode as shown in FIG. 2, the data of emissions fire1 through fire7 is the ink-emitting initial data. Since the emissions fire8 through fire17 are in the intermediate image recording mode, the data of emissions fire8 through fire17 are the ink-emitting intermediate data. Since the emissions fire18 through fire24 are in the completion image recording mode, the data of emissions fire18 through fire24 are the ink-emitting final data.

Incidentally, when an organic electroluminescent or liquid crystal color filter is created, the same filter pattern (print pattern) of the color filter is formed in the image recording area T of the recording medium. In the start image recording mode and completion image recording mode as described above, all the nozzles 21 of the recording head 2 are not arranged on the image recording area T. Even when the same pattern is to be formed, the data patterns for the ink-emitting initial data of fire1 through fire7 and the ink-emitting final data of fire18 through fire 24 are different. However, in the ink-emitting intermediate data of the fire8 through fire 17, all the nozzles 21 of the recording head 2 are located between the image recording start point and the image recording completion point. This arrangement provides the same data pattern. As described above, in the case of the same ink-emitting intermediate data pattern, the ink-emitting intermediate data of fire8 through fire17 can be integrated into one piece of ink-emitting intermediate data.

Each of the pieces of ink-emitting initial data, ink-emitting intermediate data and ink-emitting final data is assigned to each of the storage sections 7 and is stored therein. As shown in FIG. 1, the storage section 7 for storing the ink-emitting initial data is the ink-emitting initial data storage section 71; the storage section 7 for storing the ink-emitting intermediate data is the ink-emitting intermediate data storage section 72; and the storage section 7 for storing the ink-emitting final data is the ink-emitting final data storage section 73.

The image recording apparatus 1 is electrically connected with a latch 5, a shift register 6 and a plurality of storage sections 7. A controller 8 is provided for specifying the storage section 7 corresponding to the degree of the process of the emission from the nozzle 21 for forming a print pattern, out of these multiple sections 7. The controller 8 is electrically connected with an image forming apparatus PC such as a personal computer for forming image data. When image data has been inputted from the image formation apparatus, the controller 8 forms ink emitting data based on various conditions including the color data of the recording head 2, the coordinate data of each nozzle 21, image recording start mode, intermediate image recording mode, image recording completion mode and others. Then the controller 8 classifies the ink emitting data having been formed, into ink-emitting initial data, ink-emitting intermediate data and ink-emitting final data. Then the controller 8 assigns them to the ink-emitting initial data storage section 71, ink-emitting intermediate data storage section 72 and ink-emitting final data storage section 73, where they are stored, respectively.

The image recording apparatus 1 is provided with a drive waveform forming section 9 for creating the drive waveform of the recording head 2. The drive waveform forming section 9 is electrically connected with the image forming apparatus PC and head driving section 3. When an image recording start instruction has been inputted from the image forming apparatus PC, a drive waveform is created and is outputted to the head driving section 3. The image recording apparatus 1 is provided with a control section 10 for controlling various sections according to the image recording start instruction issued from the image forming apparatus PC.

Figure 3:
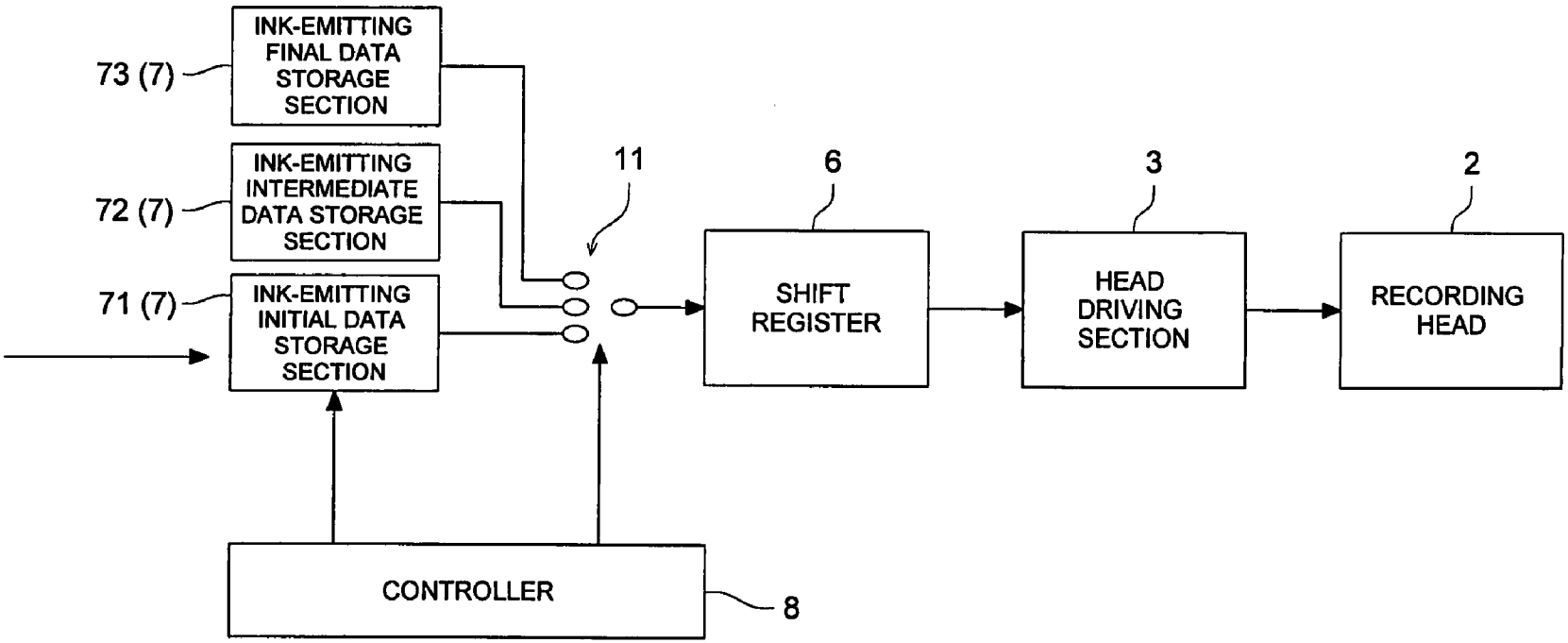
FIG. 3 is a simplified schematic view representing the image recording apparatus.

FIG. 3 is a schematic view representing the image recording apparatus 1. A data reading section 11 (not illustrated in FIG. 1) is provided between storage sections 7 and shift register 6. The data reading section 11 alternatively selects one of the storage sections 7 connected to the shift register 6 and reads out the ink emitting data on one-time emission from the nozzle 21 of each of the recording heads 2, from the storage section 7. This data reading section 11 allows the ink emitting data having been read out, to be stored in the shift register 6 for each "fire", by connecting the shift register 6 with the storage section 7 specified by the controller 8.

Figure 4:
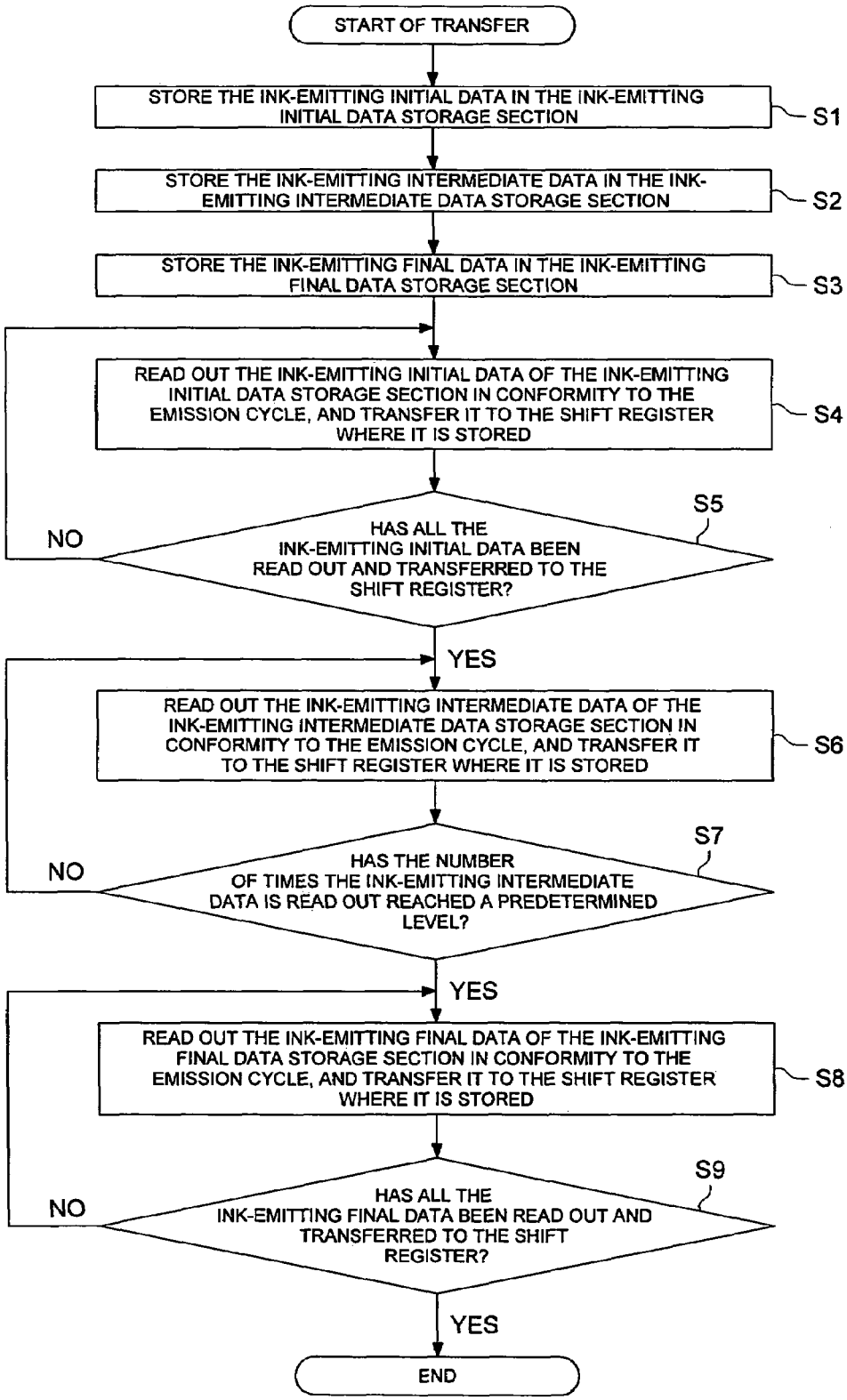
FIG. 4 is a flowchart representing the data transfer at the time of image recording operation conducted in the image recording apparatus.

The following describes the operations of the image recording apparatus 1 of the present embodiment:

FIG. 4 is a flowchart representing the data transfer at the time of image recording. When the image recording start instruction has been inputted from the image forming apparatus PC, the control section 10 controls the controller 8 and creates ink-emitting initial data based on the image data inputted from the image forming apparatus PC. The ink-emitting initial data is then stored in the ink-emitting initial data storage section 71, and the system proceeds to Step S2.

In Step S2, the control section 10 controls the controller 8 and creates ink-emitting intermediate data based on the image data inputted from the image forming apparatus PC. Then the ink-emitting intermediate data is stored in the ink-emitting intermediate data storage section 72.

In Step S3, the control section 10 controls the controller 8 and creates ink-emitting final data based on the image data inputted from the image forming apparatus PC. Then the ink-emitting final data is stored in the ink-emitting final data storage section 73.

In Step S4, the control section 10 controls the controller 8 so that the data reading section 11 will read out the ink-emitting initial data once after the shift register 6 and ink-emitting initial data storage section 71 have been connected. The data reading section 11 reads out the ink-emitting initial data of the ink-emitting initial data storage section 71 for each "fire" according to the emission cycle and transfers the data to the shift register 6 where the data is stored.

In Step S5, evaluation is made to see if all the ink-emitting initial data has been transferred to the shift register 6 or not. If all the ink-emitting initial data has not been transferred, the system proceeds to Step S4. If all the ink-emitting initial data has been transferred, the system proceeds to Step S6.

In Step S6, the control section 10 controls the controller 8 so that the data reading section 11 will read out the ink-emitting intermediate data after the shift register 6 and ink-emitting intermediate data storage section 72 have been connected. The data reading section 11 reads out the ink-emitting intermediate data of the ink-emitting intermediate data storage section 72 for each "fire" according to the emission cycle and transfers the data to the shift register 6 where the data is stored.

In Step S7, evaluation is made to see if the number of times the ink-emitting intermediate data is read out has reached a predetermined level or not. If it has reached, the system proceeds to Step S8. If it has not yet reached, the system proceeds to Step S6. The term "predetermined level" in the sense in which it is used here refers to the number of rows wherein the intermediate image recording mode is maintained. In the present embodiment, the intermediate image recording mode ranges from the destination point P8 of the 8th row to the destination point P17 of the 17th row. Accordingly, the predetermined level is set at 10.

In Step S8, the control section 10 controls the controller 8 so that the data reading section 11 will read out the ink-emitting final data once after the shift register 6 and ink-emitting final data storage section 73 have been connected. The data reading section 11 reads out the ink-emitting final data of the ink-emitting final data storage section 73 for each "fire" according to the emission cycle and transfers the data to the shift register 6 where the data is stored.

In Step S9, evaluation is made to see if all the ink-emitting initial data has been transferred to the shift register 6 or not. If all the ink-emitting initial data has not been transferred, the system proceeds to Step S8. If all the ink-emitting initial data has been transferred, data transfer terminates.

Figure 5:
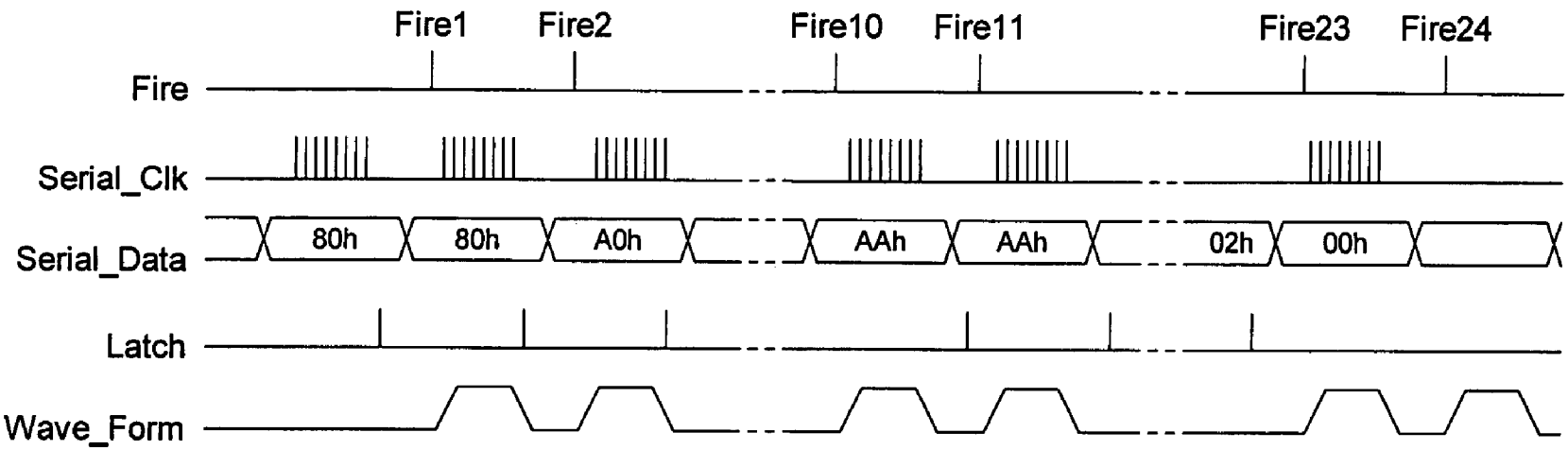
FIG. 5 is a timing chart representing a data transfer from a shift register shown in FIG. 3 to a head driving section.

When the ink emitting data has been transferred, the shift register 6 sequentially sends the ink emitting data fire1 through fire24 having been stored for each "fire" to the head driving section 3. The present invention refers to the case where a filter pattern is formed in such a way that ink is emitted in the odd-numbered rows 1, 3, 5 and 7, but ink is not emitted to the even-numbered rows 2, 4, 6 and 8. Thus, if binary data is present, "1" represents ink emission, and "0" denotes non-emission of ink. In FIG. 2, the ink emitting data of each of the fire1 through fire24 is represented in binary data format and hexadecimal data format. FIG. 5 is a timing chart representing the data transfer from the shift register 6 to the head driving section 3. As shown in this timing chart, the ink emitting data of binary data format is transferred to the head driving section 3 according to a predetermined serial clock. Upon termination of the transfer, the latch is turned on so that the terminal point of the ink emitting data is identified by the head driving section 3. The head driving section 3 superimposes the ink emitting data upon the drive wave sent from the drive waveform forming section 9. This synthesized drive waveform is used to drive the recording head 2. This procedure is repeated for each "fire", whereby the filter pattern is recorded on the image recording area T of the recording medium.

As described above, in the image recording apparatus 1 of the present invention, the ink-emitting initial data, ink-emitting intermediate data and ink-emitting final data stored in the plurality of storage sections 7 are read by the data reading section 11 and are stored by the shift register 6. After that, the head driving section 3 drives the recording head 2 based on the ink-emitting initial data, ink-emitting intermediate data and ink-emitting final data having been stored. When the same filter pattern is to be image-recorded several times, image recording can be performed several number of times by using the ink-emitting initial data, ink-emitting intermediate data and ink-emitting final data of each storage section 7, without ink emitting data being sent from the image forming apparatus PC every time. This arrangement reduces the number of times the ink emitting data is sent, and prevents image recording time from being prolonged despite higher definition of a color filter pattern, whereby high-speed image recording is ensured. Further, when the same filter pattern is image-recorded several times, the image transfer load on the host computer will be reduced if there is no need to send the ink emitting data every time, with the result that host computer operation efficiency is improved.

After the shift register 6 has stored the ink-emitting initial data having been read out once, the ink-emitting intermediate data having been read out a predetermined number of times. Then the ink-emitting final data having been read out once is stored. Thus, the ink-emitting initial data, ink-emitting intermediate data and ink-emitting final data are stored in the shift register 6 in that order. The head driving section drives the recording head 2 based on the ink emitting data stored in the shift register 6. If the ink-emitting initial data, ink-emitting intermediate data and ink-emitting final data are stored in the aforementioned order, the recording head 2 can be driven in this order. This arrangement ensures image recording in the correct order.

It is to be expressly understood, however, that the present invention is not restricted to the aforementioned embodiment. For example, the image recording apparatus 1 of the present embodiment has been described with reference to the case where the shift register 6 stores the ink-emitting intermediate data corresponding to a predetermined number of times. It is also possible to make such arrangements that, having stored the ink-emitting initial data having been read out once, the shift register 6 stores the ink-emitting intermediate data having been read out once; and after that, the shift register 6 stores the ink-emitting final data having been read out once. As described above, the ink-emitting intermediate data, all the nozzles 21 of the recording head 2 are located within the range from the image recording start point of the recording medium to the image recording completion point. This arrangement provides the same data pattern. In the case of the same ink-emitting intermediate data pattern, repeated use is allowed so long as all the nozzles 21 of the recording head 2 are kept within the range from the image recording start point of the recording medium to the image recording completion point. To be more specific, if the ink-emitting intermediate data can be repeatedly used a predetermined number of times when the head driving section 3 drives the recording head 2 based on the ink-emitting intermediate data, the transfer time can be reduced as compared to the case where the ink-emitting intermediate data is read out several times.

A plurality of storage section 7 are made up of a ink-emitting initial data storage section 71 for storing the ink-emitting initial data, an ink-emitting intermediate data storage section 71 for storing the ink-emitting intermediate data, and a ink-emitting final data storage section 73 for storing the ink-emitting final data. This arrangement enables separate management of ink-emitting initial data, ink-emitting intermediate data and ink-emitting final data.

As described above, in the present embodiment, for the sake of data management, the ink-emitting initial data is stored in the ink-emitting initial data storage section 71, the ink-emitting intermediate data in the ink-emitting intermediate data storage section 72, and the ink-emitting final data in the ink-emitting final data storage section 73. However, three pieces of ink emitting data can be stored in two storage sections. Alternatively, the emission can be stored in four or more storage sections.

For example, when three or more pieces of ink emitting data are to be stored in two storage sections, the ink-emitting initial data is stored in one of the storage sections at the time of starting the image recording. At the same time, the ink-emitting intermediate data is stored in the other storage section. The ink-emitting final data is stored in one of the storage sections when an image is being recorded based on the ink-emitting intermediate data after completion of image recording by the ink-emitting initial data.

In another example, when ink emitting data is stored in four or more storage sections, the ink-emitting initial data, ink-emitting intermediate data and ink-emitting final data are separated and are stored separately. Alternatively, if at least one of the ink-emitting initial data, ink-emitting intermediate data and ink-emitting final data is used in a plurality of types, the data can be separately stored for each piece of ink-emitting intermediate data.

Embodiment 2

Figure 6:
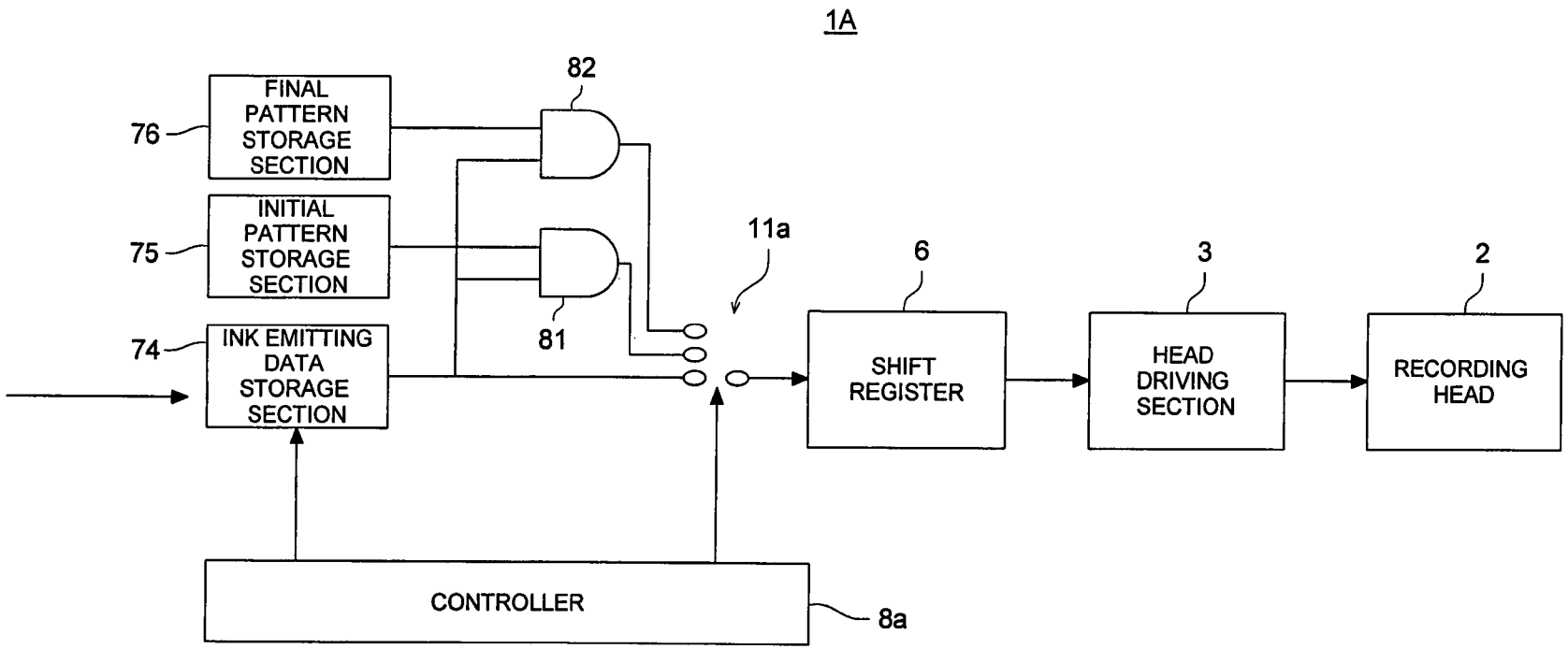
FIG. 6 is a block diagram representing a main control structure of an image recording apparatus as a second embodiment of the present invention.

In the first embodiment, the present invention has been described with reference to the image recording apparatus 1 wherein the ink emitting data on a plurality of emissions is separated into the ink-emitting initial data, ink-emitting intermediate data and ink-emitting final data to perform image recording. In the second embodiment, FIG. 6 is used to describe the image recording apparatus 1A for recording an image in the image recording area T of the recording medium using the mask pattern in the image recording start mode and image recording completion mode. The same portions as the aforementioned image recording apparatus 1 of the first embodiment will be assigned with the same numerals of reference, and will not be described to avoid duplication.

As shown in FIG. 6, the image recording apparatus 1A is provided with the ink emitting data storage section 74 for storing the ink emitting data of the recording head 2 formed based on the image data. The ink emitting data having the same data pattern is stored in this ink emitting data storage section 74 in the case of recording the ink emitting data of the filter pattern wherein the same pattern is formed in the image recording area T of the recording medium.

The image recording apparatus 1A is equipped with a initial pattern storage section 75 for storing the initial mask pattern data for forming a mask pattern when the recording head 2 is in the image recording start mode; and a final pattern storage section 76 for storing the mask pattern data for storing the final mask pattern data for forming a mask pattern when the recording head 2 is in the image completion mode.

The mask pattern in the sense in which it is used here is intended to restrict ink emission from the nozzle 21 to ensure that ink will not be emitted from the nozzle 21 arranged outside the image recording area T of the recording medium.

The image recording apparatus 1A is equipped with: a ink-emitting initial data synthesizing section 81 for synthesizing the initial mask pattern data of the initial pattern storage section 75 with the ink emitting data of an ink emitting data storage section 74; a ink-emitting final data synthesizing section for synthesizing the final mask pattern data of the final pattern storage section 76 with the ink emitting data of the ink emitting data storage section 74; a controller 8*a* for specifying one of the ink emitting data storage section 74, ink-emitting initial data synthesizing section 81 and ink-emitting final data synthesizing section 82, according to the degree of progress of emission from the nozzle 21 for forming a print pattern. In the following description, the ink emitting data synthesized with the initial mask pattern data will be called the initial synthesis data, and the ink emitting data synthesized with the final mask pattern data will be called the final synthesis data.

A data reading section 11*a* is arranged between the ink emitting data storage section 74 and ink-emitting initial data synthesizing section 81, and between the ink-emitting final data synthesizing section 82 and shift register 6, wherein the data reading section 11*a* connects any one of the ink emitting data storage section 74, ink-emitting initial data synthesizing section 81 and ink-emitting final data synthesizing section 82, with the shift register 6, and reads out any one of the non-synthesized ink emitting data, initial synthesis data and final synthesis data.

The following describes the operations of the image recording apparatus 1A of the second embodiment.

When an image recording start instruction is inputted from the image forming apparatus PC, the controller 10 controls the controller 8*a* to create ink emitting data based on the image data inputted from the image forming apparatus PC, and this ink emitting data is stored in the ink emitting data storage section 74.

The control section 10 controls the controller 8*a* so that the data reading section 11*a* will read out the initial synthesis data once after the shift register 6 and ink-emitting initial data synthesizing section 81 have been connected. The data reading section 11*a* reads out the initial synthesis data in conformity to the emission cycle and allows it to be stored in the shift register 6.

After termination of storage of the initial synthesis data, the control section 10 controls the controller 8*a* in such a way that the non-synthesized ink emitting data will be read out after the shift register 6 and ink emitting data storage section 74 have been connected. The data reading section 11*a* reads out the non-synthesized ink emitting data of the ink emitting data storage section 74 for each "fire" in conformity to the emission cycle, and the data is transferred to the shift register 6 where it is stored.

The control section 10 controls the controller 8*a* so that the data reading section 11*a* will read out the ink-emitting initial data once after the shift register 6 and ink-emitting final data synthesizing section 82 have been connected. The data reading section 11*a* reads out the final synthesis data of the ink-emitting final data synthesizing section 82 for each "fire" in conformity to the emission cycle, and the data is transferred to the shift register 6 where it is stored.

Thus, data transfer terminates after all the ink-emitting final data synthesis data has been read out and stored into the shift register 6.

Figure 7:
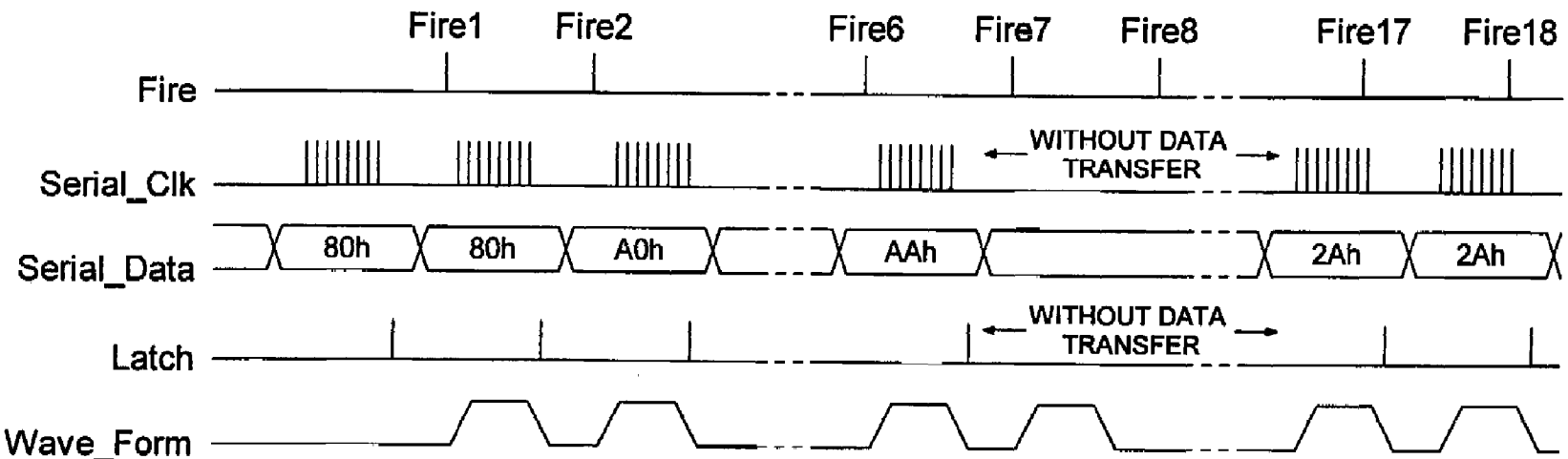
FIG. 7 is a timing chart representing a data transfer from a shift register shown in FIG. 6 to a head driving section.
Figure 8:
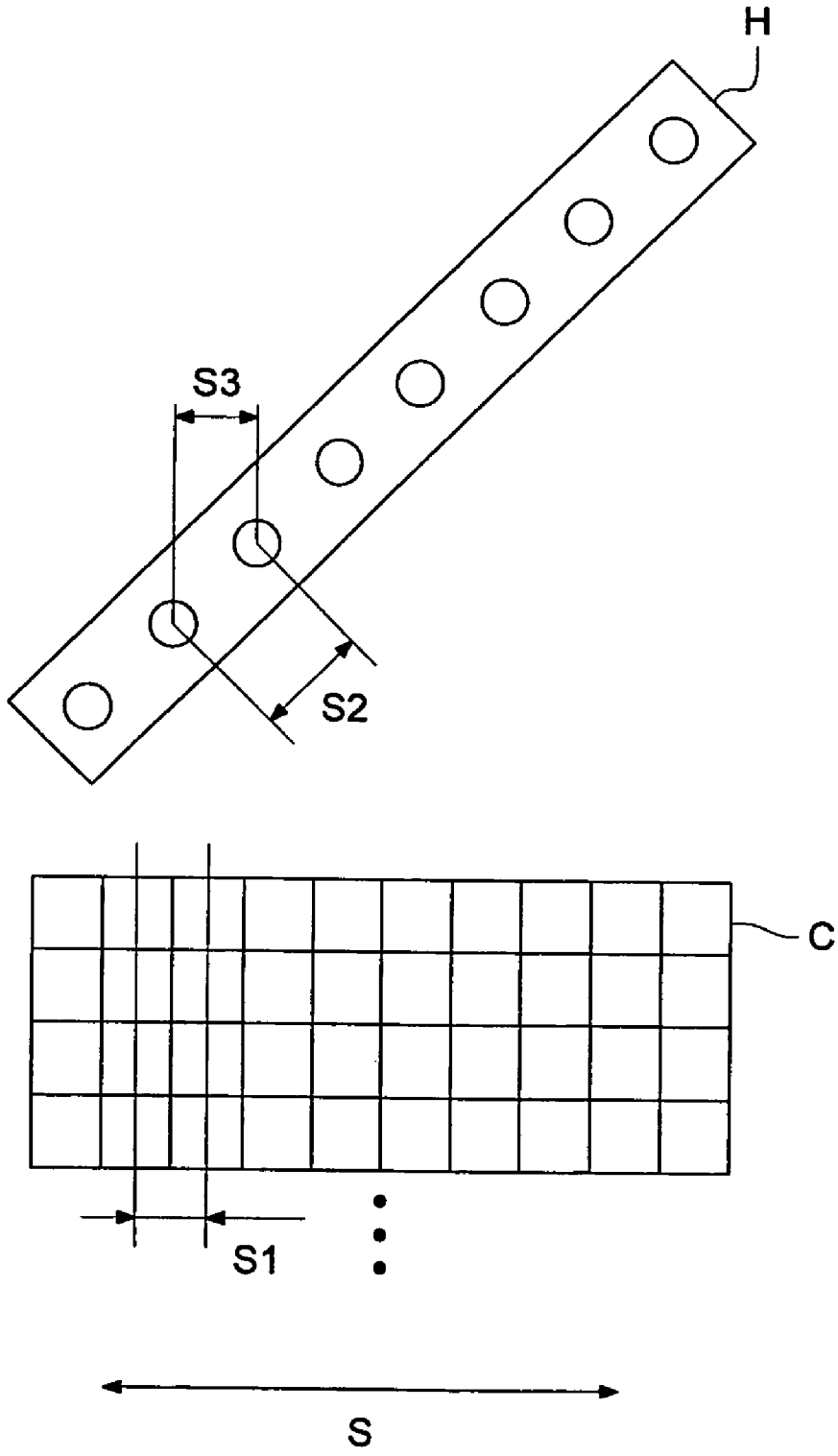
FIG. 8 is a explanatory schematic diagram representing a relationship between nozzles of a conventional recording head and a filter pattern.

For example, if the same filter pattern as that for the image recording apparatus 1 of the first embodiment is to be formed for the image recording apparatus 1A of the second embodiment, then the ink emitting data of each "fire" stored in the shift register 6 will have the same data pattern as that of the ink emitting data shown in FIG. 2. FIG. 7 is a timing chart representing the data transfer from the shift register 6 to the head driving section 3. As shown by the timing chart of FIG. 7, the ink emitting data of the binary format is transferred to the head driving section 3 at a predetermined serial clock. Upon completion of transfer, the latch is turned on and the end point of the ink emitting data is identified by the head driving section 3. The head driving section 3 synthesizes the ink emitting data and the drive waveform inputted from the drive waveform forming section 9, and the recording head 2 is driven by the synthesized drive waveform. This procedure is repeated for each "fire", whereby the filter pattern is recorded on the image recording area T of the recording medium. In the second embodiment, it should be noted that the ink emitting data of fire8 through fire17 is the same; and therefore, the data is transferred from the shift register 6 to the head driving section 3 in one operation, and the head driving section 3 repeatedly uses the non-synthesized ink emitting data having been transferred once, a predetermined number of times, whereby the recording head is driven.

As described above, the image recording apparatus 1A of the second embodiment allows the non-synthesized ink emitting data, initial synthesis data and final synthesis data to be read out by the data reading section 11*a*. After the shift register 6 has stored the non-synthesized ink emitting data, initial synthesis data and final synthesis data, the head driving section 3 drives the recording head 2, based on the stored non-synthesized ink emitting data, initial synthesis data and final synthesis data. Thus, when one and the same print pattern is to be image-recorded several times, initial synthesis data and final synthesis data can be synthesized without having to transfer the ink emitting data every time, and image recording can be performed several times. This arrangement reduces the number of times the ink emitting data is sent, and prevents the image recording time from being prolonged, even if the higher definition of the print pattern of the color filter has been used. Thus, a higher image speed is ensured.

Further, after storing the initial synthesis data having been read once, the shift register 6 stores the non-synthesized ink emitting data having been read once; and after that, the shift register 6 stores the final synthesis data having been read out once. Accordingly, the shift register 6 stores the initial synthesis data, non-synthesized ink emitting data and final synthesis data in that order. The head driving section 3 drives the recording head 2 based on the ink emitting data stored in the shift register 6. If the initial synthesis data, non-synthesized ink emitting data and final synthesis data are stored in this order, the head driving section 3 can drive the recording head 2 according to this order, thus making it possible to record the image in right sequence. As describe above, if non-synthesized ink emitting data is used a number of predetermined times when the head drives section 3 drives the recording head 2 based on non-synthesized ink emitting data, data transfer time can be reduced as compared to the case where the non-synthesized ink emitting data is read out several times.

The present embodiment has been described with reference to the image recording apparatus 1A equipped with one initial pattern storage section 75 and one final pattern storage section 76. At least one of the initial pattern storage section 75 and final pattern storage section 76 to be provided may be more than one. Even when more than one initial mask pattern data and more than one final mask pattern data are used, they can be stored separately, if this arrangement is used.

Embodiment 3

The first embodiment has been described with reference to the case where the ink emitting data on a plurality of emissions is made up of the ink-emitting initial data, ink-emitting intermediate data and ink-emitting final data. The third embodiment will be described with reference to the case where the ink emitting data on a plurality of emissions is made up of at least two of the ink-emitting initial data, ink-emitting intermediate data and ink-emitting final data. The same portions as the aforementioned image recording apparatus 1 of the first embodiment will be assigned with the same numerals of reference, and will not be described to avoid duplication.

At least two of the ink-emitting initial data, ink-emitting intermediate data and ink-emitting final data in the aforementioned description includes a combination of ink-emitting initial data and ink-emitting intermediate data, a combination of ink-emitting intermediate data and ink-emitting final data, a combination of ink-emitting initial data and ink-emitting final data, and a combination of ink-emitting initial data, ink-emitting intermediate data and ink-emitting final data. It includes the case where the ink-emitting intermediate data is separated into more than one piece. If the total number of the pieces of ink emitting data on a plurality of emissions does not exceed the total number of the storage sections 7, the ink emitting data can be stored in the storage section 7 before recording the image. However, depending on the apparatus configuration, the aforementioned total number of the ink emitting data may be greater than that of the storage sections 7. In this case, all the ink emitting data cannot be stored prior to image recording. Assume, for example, that ink emitting data on a plurality of emissions is made up of ink-emitting initial data, ink-emitting intermediate data and ink-emitting final data, and two storage sections 7 are provided. In this case, the data reading section 11 reads out the ink-emitting initial data and is stored in one of the storage sections 7. Then the ink-emitting intermediate data is read out and is stored in the other storage section 7. In the process of reading the ink-emitting intermediate data, all the ink-emitting initial data has already been sent to the shift register 6 for each "fire". Accordingly, the data reading section 11 reads out the ink-emitting final data and stores it in one of the storage section 7.

Thus, the head driving section 3 drives the recording head 2 based on the transfer data made up of the ink-emitting initial data, ink-emitting intermediate data and ink-emitting final data that are transferred to the shift register 6 after having been stored in two storage sections 7.

To put it another way, at least two of the ink-emitting initial data, ink-emitting intermediate data and ink-emitting final data stored in the storage sections 7 are read out by the data reading section 11. The head driving section drives the recording head 2, based on at least two of the ink-emitting initial data, ink-emitting intermediate data and ink-emitting final data having been stored in the shift register 6.

According to the present invention, when the same filter pattern is repeatedly recorded for plural times, it becomes possible to conduct recording operation for plural times without transferring the ink emitting data for every time, since it is possible to generate the synthesized ink-emitting initial data, the synthesized ink-emitting intermediate data and the synthesized ink-emitting final data by employing the ink-emitting initial data, the ink-emitting intermediate data and the ink-emitting final data or based on the non-synthesized ink emitting data. Therefore, it becomes possible not only to reduce the number of times for transferring the ink emitting data, but also to prevent the redundant time duration for the image recording operation, even if the filter pattern of the color filter is formed in a high definition pattern, resulting in a high speed image recording operation. Further, if it is not necessary to transfer the ink emitting data for every time when the same filter pattern is repeatedly recorded for plural times, it is possible for the host computer to reduce the burden of image transferring operations, resulting in an improvement of the operating efficiency of the host computer.

While the preferred embodiments of the present invention have been described using specific term, such description is for illustrative purpose only, and it is to be understood that changes and variations may be made without departing from the spirit and scope of the appended claims.

What is claimed is:

1. An image recording apparatus, comprising:

a recording head that includes a plurality of ink emitting nozzles for emitting ink onto a recording medium, wherein said plurality of ink emitting nozzles are aligned in a linear direction intersecting a plane orthogonal to a conveying direction of said recording medium with a predetermined angle;

a plurality of storing sections to store ink emitting data for every unit ink emitting action, wherein said ink emitting data represent an ink emitting action conducted by each of said plurality of ink emitting nozzles corresponding to a specific printing pattern;

a controller to selectively designate a specific storing section from said plurality of storing sections corresponding to a current progress status of ink emitting actions conducted by said plurality of ink emitting nozzles, and to sequentially read out said ink emitting data from said specific storing section for every unit ink emitting action, in order to depict said specific printing pattern;

a shift register to sequentially store said ink emitting data, read by said controller, for every unit ink omitting action; and a head driving section to sequentially drive said recording head for every unit ink emitting action, based on said ink emitting data, wherein said ink emitting data includes at beast two of ink-emitting initial data, ink-emitting final data and ink-emitting intermediate data; and wherein said ink-emitting initial data represent ink emitting actions to be conducted from a time when a leading ink-emitting nozzle, located at a leading edge portion of said recording head, is positioned on an image recording start line of said recording medium to a time when a trailing ink-emitting nozzle, located at a trailing edge portion of said recording head, is positioned on said image recording start line; said ink-emitting final data represent ink emitting actions to be conducted front a time when said leading ink-emitting nozzle is positioned on an image recording stop line of said recording medium to a time when said trailing ink-emitting nozzle is positioned on said image recording stop line; and said ink-emitting intermediate data represent ink emitting actions to be conducted during an intermediate time interval from a completion of said ink-emitting initial data to a start of said ink-emitting final data.

2. The image recording apparatus of claim 1, wherein, when at least two of said ink-emitting initial data, said ink-emitting intermediate data and said ink-emitting final data are stored into said shift register as said ink emitting data, said head driving section drives said recording head, based on said ink emitting data stored in said shift register.

3. The image recording apparatus of claim 2, wherein said plurality of storing sections includes an ink-emitting initial data storage for storing said ink-emitting initial data, an ink-emitting intermediate data storage for storing said ink-emitting intermediate data and an ink-emitting final data storage for storing said ink-emitting final data.

4. The image recording apparatus of claim 3, wherein, after said ink-emitting initial data are stored into said shift register, said controller repeatedly reads out said ink-emitting intermediate data for a predetermined number of times from said ink-emitting intermediate data storage so that said ink-emitting intermediate data read-out are sequentially stored into said shift register.

5. The image recording apparatus of claim 3, wherein said ink-emitting initial data, said ink-emitting intermediate data and said ink-emitting final data are stored into said shift register; and wherein said head driving section drives said recording head so that said recording head repeatedly conducts a same ink emitting action for a predetermined number of times, based on said ink-emitting intermediate data stored in said shift register.

6. An image recording apparatus, comprising:

a recording head that includes a plurality of ink emitting nozzles for emitting ink onto a recording medium, wherein said plurality of ink emitting nozzles are aligned in a linear direction intersecting a plane orthogonal to a conveying direction of said recording medium with a predetermined angle;

an ink emitting data storing section that includes a plurality of storing sections to store ink emitting data for every unit ink emitting action, wherein said ink emitting data represent an ink emitting action conducted by each of said plurality of ink emitting nozzles corresponding to a specific printing pattern;

an initial mask pattern storing section to store initial mask pattern data representing an initial mask pattern to be formed during a period from a time when a leading ink-emitting nozzle, located at a leading edge portion of said recording head, is positioned on an image recording start line of said recording medium to a time when a trailing ink-emitting nozzle, located at a trailing edge portion of said recording head, is positioned on said image recording start line;

a final mask pattern storing section to store final mask pattern data representing a final mask pattern to be formed during a period from a time when said leading ink-emitting nozzle is positioned on an image recording stop line of said recording medium to a time when said trailing ink-emitting nozzle is positioned on said image recording stop line;

an ink-emitting initial data synthesizing section to synthesize said ink emitting data, read from said ink emitting data storing section, and said final mask pattern data, read from said final mask pattern storing section, with each other, so as to generate and output ink-emitting initial data;

an ink-emitting final data synthesizing section to synthesize said ink emitting data, read from said ink emitting data storing section, and said final mask pattern data, read from said final mask pattern storing section, with each other, so as to generate and output ink-emitting final data;

a controller to selectively designate any one of said ink emitting data, said ink-emitting initial data and said ink-emitting final data, which are outputted from corresponding one of said ink emitting data storing section, said ink-emitting initial data synthesizing section and said ink-emitting final data synthesizing section, as designated ink-emitting data, corresponding to a current progress status of ink emitting actions conducted by said plurality of ink emitting nozzles;

a shift register to sequentially store said designated ink-emitting data, designated by said controller, for every unit ink emitting action; and a head driving section to sequentially drive said recording head for every unit ink emitting action, based on said designated ink-emitting data.

7. The image recording apparatus of claim 6, wherein, initially, said ink-emitting initial data are stored into said shift register as designated ink-emitting data, and next, said ink emitting data, which are repeatedly read out for a predetermined number of times, are stored into said shift register as designated ink-emitting data, and then, said ink-emitting final data are stored into said shift register as designated ink-emitting data.

8. The image recording apparatus of claim 7, wherein said head driving section drives said recording head so that said recording head repeatedly conducts a same ink emitting action for a predetermined number of times, based on ink emitting data stored in said shift register.

* * * * *